US009155411B2

(12) United States Patent
Woo

(10) Patent No.: US 9,155,411 B2
(45) Date of Patent: Oct. 13, 2015

(54) CHOPSTICKS

(76) Inventor: Chat Ming Woo, Hong Kong (CN)

( * ) Notice: Subject to any disclaimer, the term of this patent is extended or adjusted under 35 U.S.C. 154(b) by 0 days.

(21) Appl. No.: 14/366,681

(22) PCT Filed: Dec. 20, 2011

(86) PCT No.: PCT/CN2011/002141

§ 371 (c)(1),
(2), (4) Date: Jun. 19, 2014

(87) PCT Pub. No.: WO2013/091134

PCT Pub. Date: Jun. 27, 2013

(65) Prior Publication Data

US 2014/0367988 A1 Dec. 18, 2014

(51) Int. Cl.
*A47G 21/10* (2006.01)
*A47G 21/06* (2006.01)

(52) U.S. Cl.
CPC ..... *A47G 21/103* (2013.01)

(58) Field of Classification Search
CPC ..... A47G 21/103
USPC ..... 294/99.2, 218, 16, 25; 401/8
See application file for complete search history.

(56) References Cited

U.S. PATENT DOCUMENTS

| | | | | |
|---|---|---|---|---|
| 5,277,464 | A * | 1/1994 | Okun | 294/218 |
| 7,182,378 | B2 | 2/2007 | Inomata et al. | |
| 8,235,440 | B2 | 8/2012 | Park | |
| D680,388 | S | 4/2013 | Woo | |
| 2005/0099031 | A1 | 5/2005 | Park | |
| 2005/0134065 | A1 | 6/2005 | Inomata et al. | |
| 2007/0187962 | A1 * | 8/2007 | Park | 294/1.1 |
| 2011/0169286 | A1 * | 7/2011 | Huang | 294/99.2 |
| 2012/0133167 | A1 * | 5/2012 | Woo | 294/218 |

FOREIGN PATENT DOCUMENTS

| | | | |
|---|---|---|---|
| CN | 87205972 | U | 12/1987 |
| CN | 2712200 | Y | 7/2005 |
| CN | 2766697 | Y | 3/2006 |
| CN | 1953686 | A | 4/2007 |
| CN | 101040752 | A | 9/2007 |
| CN | 101947042 | A | 1/2011 |
| CN | 200910159273.X | | 2/2011 |
| CN | 201010116591.0 | | 2/2011 |
| CN | 101991331 | A | 3/2011 |
| CN | 201822516 | U | 5/2011 |
| CN | 103169342 | A | 6/2013 |
| CN | 203106637 | U | 8/2013 |
| CN | 203106638 | U | 8/2013 |
| CN | 102612329 | B | 5/2014 |
| CN | 302929097 | S | 9/2014 |
| DE | 001394662-0001 | S | 2/2014 |

(Continued)

*Primary Examiner* — Gabriela Puig
(74) *Attorney, Agent, or Firm* — Eagle IP Limited; Jacqueline C. Lui

(57) ABSTRACT

The invention relates to a pair of chopsticks, comprising: an upper chopstick, and a lower chopstick with a first protrusion and a second protrusion, wherein both of the first and second protrusions protrude from the back surface of the lower chopstick, so that at the holding status of the chopsticks, the first protrusion can touch the vicinity of the first joint of the ring finger of user and the second protrusion can touch the finger pad of the third section of the index finger of user. With the two protrusions coexisting in the lower chopstick, the chopsticks can be firmly held by hand of users.

34 Claims, 8 Drawing Sheets

(56) References Cited

FOREIGN PATENT DOCUMENTS

| | | | | | |
|---|---|---|---|---|---|
| EP | 2462847 | A1 | | 6/2012 | |
| HK | 1100166.4M001 | S | | 6/2011 | |
| HK | 1100166.4M002 | S | | 6/2011 | |
| HK | 1100166.4M003 | S | | 6/2011 | |
| HK | 1100166.4M004 | S | | 6/2011 | |
| HK | 1100166.4M005 | S | | 6/2011 | |
| HK | 1100166.4M006 | S | | 6/2011 | |
| HK | 1301017.2 | S | | 1/2014 | |
| JP | 1977118336 | A | | 10/1977 | |
| JP | h08-022241 | A | | 1/1996 | |
| JP | 08076683 | A | * | 3/1996 | G09B 19/24 |
| JP | 09044078 | A | * | 2/1997 | G09B 19/24 |
| JP | 1997044078 | A | | 2/1997 | |
| JP | h09-044078 | A | | 2/1997 | |
| JP | h10-228234 | A | | 8/1998 | |
| JP | 10282878 | A | * | 10/1998 | G09B 19/24 |
| JP | 2000-83788 | A | | 3/2000 | |
| JP | 2000083788 | A | * | 3/2000 | A47G 21/10 |
| JP | 2004-62194 | A | | 2/2004 | |
| JP | 3756903 | B2 | | 2/2004 | |
| JP | 2004057788 | A | | 2/2004 | |
| JP | 2006-181321 | A | | 7/2006 | |
| JP | 2006181321 | A | * | 7/2006 | A47G 21/10 |
| JP | 2006-263462 | A | | 10/2006 | |
| JP | 2013128774 | A | | 7/2013 | |
| JP | D1501977 | S | | 7/2014 | |
| KR | 1020020088215 | A1 | | 11/2002 | |
| KR | 100890777 | B1 | | 3/2009 | |
| TW | 201325510 | A | | 7/2013 | |
| WO | WO03/015589 | A1 | | 2/2003 | |
| WO | WO 03015589 | A1 | * | 2/2003 | A47G 21/10 |
| WO | WO2006/004290 | A1 | | 1/2006 | |
| WO | WO 2006004290 | A1 | * | 1/2006 | A47G 21/10 |
| WO | WO2011015033 | A1 | | 2/2011 | |
| WO | WO 2011015033 | A1 | * | 2/2011 | A47G 21/10 |
| WO | WO 2013181822 | A1 | * | 12/2013 | A47G 21/10 |

* cited by examiner

CHOPSTICKS

CROSS REFERENCE

The application claims the priority of International Application No. PCT/CN2011/002141 filed on Dec. 20, 2011, the whole of which is hereby incorporated by reference herein.

TECHNICAL FIELD

The present invention relates to chopsticks, and more specifically to chopsticks with structures for better holding.

BACKGROUND

For three thousand years, Chinese people have been using chopsticks as eating utensils. FIG. 1 shows a pair of commonly used chopsticks, comprising a rod-shaped upper chopstick 10 and a rod-shaped lower chopstick 20. Generally, the ends of chopsticks used for gripping food are called as distal ends 18, 28, and the other ends are called as rear ends 19, 29. The surfaces touching the thumb of user are called as front surfaces 11, 21; the surfaces on the upper side are called as upper surfaces 12, 22; the surfaces touching the ring finger and the index finger are called as back surfaces 13, 23 (see FIG. 2, which shows a back view of the chopsticks in FIG. 1); the surfaces on the bottom side are called as bottom surfaces (not shown). Nevertheless, the shape of the cross-section of a chopstick is not limited to square or rectangle. It can also be other shapes such as polygon, circle, ellipse, etc; in these cases, as one skilled in the art can understand, the chopsticks can be similarly deemed as having the above-mentioned surfaces.

FIG. 1 and FIG. 2 show the correct posture for holding chopsticks. In the chopstick holding status, the vicinity of the first joint of ring finger 36 and the base of the third section of index finger 38 touches the back surface of the lower chopstick, and the second section of the thumb presses the front surface of the lower chopstick. In this way, the lower chopstick can be gripped firmly by these three finger positions. Although the lower chopstick remains fixed relatively to these three finger positions, the upper chopstick is movable. The first section of the thumb and third section of the index finger press the upper chopstick, and the first section of the index finger and the first section of the middle finger move the upper chopstick up or down, such that the upper chopstick can open and close relative to the lower chopstick for gripping and releasing food.

It is known that holding chopsticks in the correct posture is difficult, even to adults. Currently, some chopsticks are provided with one protrusion which can be touched with a particular position of hand, in order to facilitate user to hold the chopsticks in a correct posture. FIG. 3 shows some positions of hand, wherein positions 1, 4 may be touched with the protrusion of current chopsticks. For example, JP 09-044078 discloses a protrusion located on the lower chopstick for touching the vicinity of the first joint of the ring finger, i.e., position 1 of hand as shown in FIG. 3. Further, WO 2011/015033 discloses a protrusion arranged on the lower chopstick for touching finger pad of the third section of the index finger, i.e., position 4 of hand as shown in FIG. 3.

These designs, although can enhance the holding stability to some extent, still have some problems. For example, when there is only one protrusion, the holding position of hand will easily shift away from the correct position. This problem is shown in FIG. 4, which is the top view of the lower chopstick. Reference numbers 41, 44 and 40 therein are the cross section representation of first joint of ring finger, third section of the index finger and second section of thumb, respectively. As shown in FIG. 4, when there is only one protrusion 54, finger joint 41 and section 44 may shift to an incorrect position, so that the solitary protrusion 54 will be in the middle of the two finger joint/section, instead of touching finger joint 41 or section 44. Therefore, the protrusion 54 cannot touch user's hand in a correct and firm manner, and as a result cannot guide the hand to stay in the correct chopstick holding posture.

SUMMARY OF THE INVENTION

The invention aims to provide a pair of chopsticks which can be easily held by hand in a firm and steady manner.

According to an aspect of the invention, a pair of chopsticks is provided, comprising: an upper chopstick, and a lower chopstick with a first protrusion and a second protrusion, wherein both of the first and second protrusions protrude from the back surface of the lower chopstick, so that at the holding status of the chopsticks, the first protrusion can touch the vicinity of the first joint of the ring finger of user and the second protrusion can touch the finger pad of the third section of the index finger of user.

The first protrusion and/or the second protrusion can be in form of rod or plate.

In an embodiment, a connecting element is arranged for connecting the first protrusion and the second protrusion. Preferably, the connecting element touches the vicinity of the second joint of the ring finger of user. In an example, the first and second protrusions and the connecting element together form a half-ring structure. Advantageously, the half-ring structure is extended to form a quarter-spheroid structure, wherein at the holding status of chopsticks the quarter-spheroid structure blocks the second section of the middle finger from getting too close to the lower chopstick.

To facilitate holding of chopsticks, the first protrusion and the second protrusion can be arranged so that the distance L1 from the back surface of the lower chopstick to the top end of the connecting element and the distance L2 from the middle of the first protrusion and the second protrusion to the distal end of the lower chopstick satisfy the following relationship: $L1\times(10\sim15)>L2$.

According to another aspect of the invention, a pair of chopsticks is provided, comprising: an upper chopstick, and a lower chopstick with a half-ring, the two ends of the half-ring being mounted on the back surface of the lower chopstick and the circumference of the half-ring protruding from the back surface of the lower chopstick.

In an embodiment, a quarter-spheroid is extended on the top of the half-ring, the upper edge of the quarter-spheroid protruding from the upper surface of the lower chopstick and the lower edge of the quarter-spheroid merging with the half-ring.

According to a further aspect of the invention, a pair of chopsticks is provided, comprising: an upper chopstick, and a lower chopstick, with a projection protruding from the back surface of the lower chopstick, the free end of which touches the vicinity of the second joint of the ring finger of user at the holding status of chopsticks.

To facilitate holding of chopsticks, location of the projection can be arranged so that the distance L1' from the back surface of the lower chopstick to the free end of the projection and the distance L2' from the middle of the projection to the distal end of the lower chopstick satisfy the following relationship: L1'×(10~15)>L2'.

In an example, the projection can be in form of rod or plate.

DETAILED DESCRIPTION OF THE INVENTION

In the following, the present invention will be discussed in details with reference to the attached figures by means of some particular examples. It should be noted that the examples and figures as shown are directed to chopsticks and protrusions for right-handed users. However, one skilled in the art can easily design the variants suitable for left-hand users, and these variants also fall within the scope of the present invention.

The present invention reveals structures of protrusions or the like located on the lower chopstick for helping user to hold the chopsticks in a correct posture. Protrusions would touch position or positions of the hand. In the context the term "touch" means the protrusion is in contact with positions on user's hand at the holding status of chopstick, as well as being kept at a very close distance from positions in user's hand at the holding status of chopstick (i.e., loosely touch).

Figure 3:
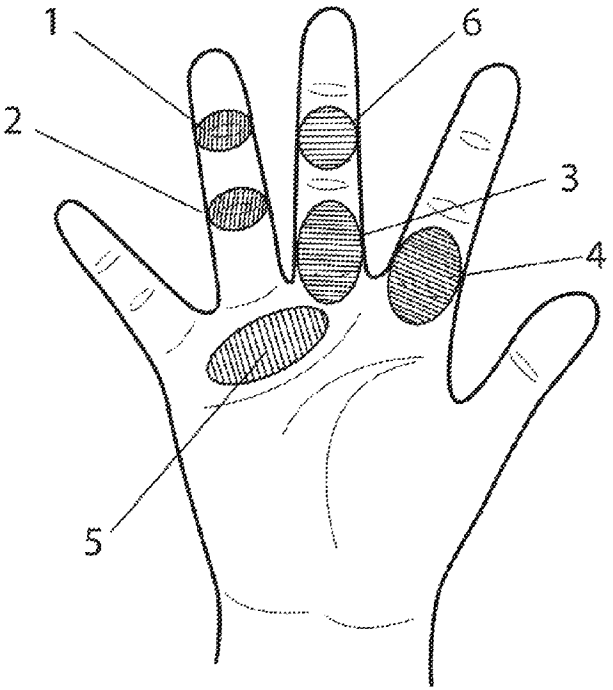
FIG. 3 (Prior Art)
FIG. 3 shows positions on the hand that may be touched by integral protrusions of the chopsticks.
Figure 1:
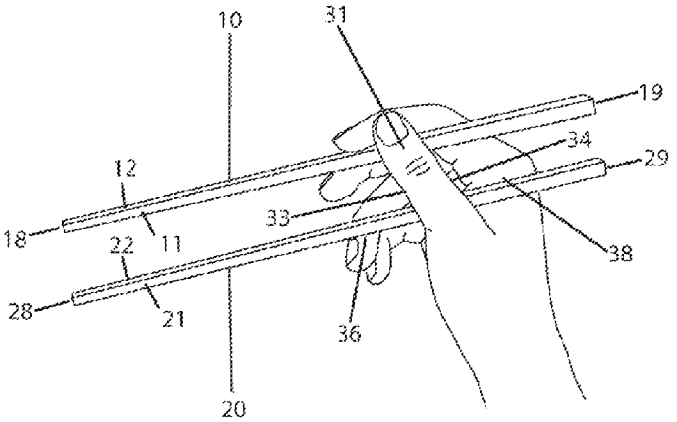
FIG. 1 (Prior Art)
FIGS. 1 and 2 are the front view and back view of the correct posture of holding a pair of chopsticks respectively.
Figure 2:
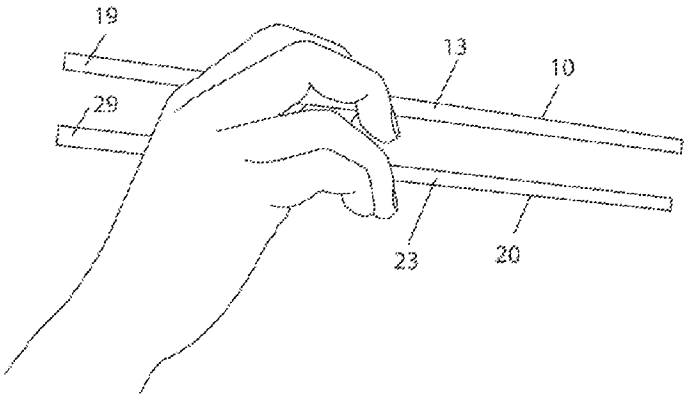
FIG. 2 (Prior Art)
Figure 5:
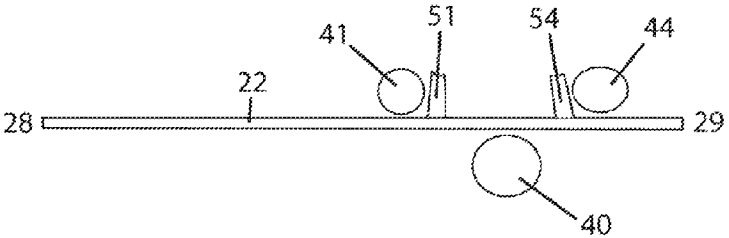

FIG. 5 shows the first embodiment of the present invention, which is the top view of the lower chopstick, wherein reference numbers 41, 44 and 40 are the cross section representations of first joint of ring finger, third section of the index finger, and second section of thumb respectively. As shown, two protrusions, i.e., the first protrusion 51 and the second protrusion 54, coexist on the lower chopstick and both protrude from the back surface of the lower chopstick. The two protrusions can be integral with the lower chopstick, or be separate members and mounted on the lower chopstick through conventional means. In the holding status of chopsticks, the first protrusion 51 touches the vicinity of the first joint of ring finger 41, and the second protrusion 54 touches the finger pad of the third section of index finger 44. That means these two protrusions 51 and 54 respectively touch positions 1 and 4 of the hand as shown in FIG. 3. In this way, the fingers cannot be significantly shifted away from the contacting points, preventing the finger joint 41 and the finger section 44 from getting too close. Thus a firm and steady holding posture can be obtained.

Figure 6:
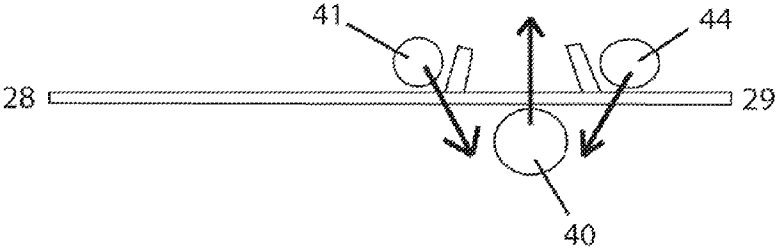
FIGS. 5 and 6 show an embodiment with two protrusions according to the invention.

FIG. 6 shows the force exerted by finger joint/sections 41, 44, and 40. Three forces, schematically shown by arrows, grip the lower chopstick very firmly. In this case, the finger joint 41 and section 44 would neither shift too far nor too close to the distal end 28 of the lower chopsticks. Consequently, the chopsticks can be held in a firm way.

Figure 7:
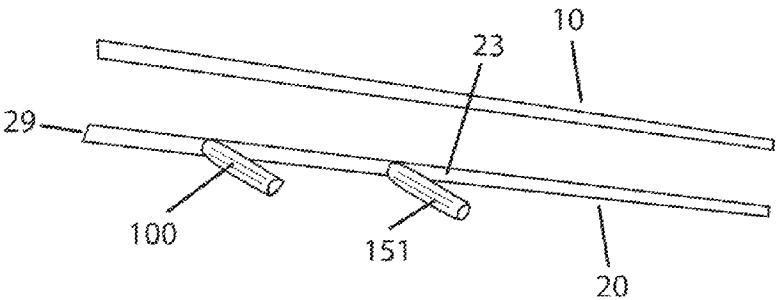
FIGS. 7-10 show some variants of the embodiment as shown in FIG. 5
Figure 4:
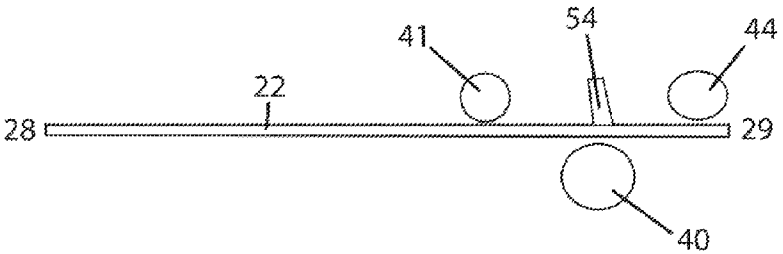
FIG. 4 (Prior Art)
FIG. 4 shows the problems of prior arts.

FIG. 7 is an example showing the back perspective view of the upper and lower chopsticks. In this example, the first and second protrusions are in form of rod 151 and rod 100 respectively. The two rods 151, 100 are located at the back surface of the lower chopstick and coexist. One ends of rods 100 and 151 are mounted on the back of the lower chopstick, and the other ends protrude from the back of the lower chopstick.

Figure 10:
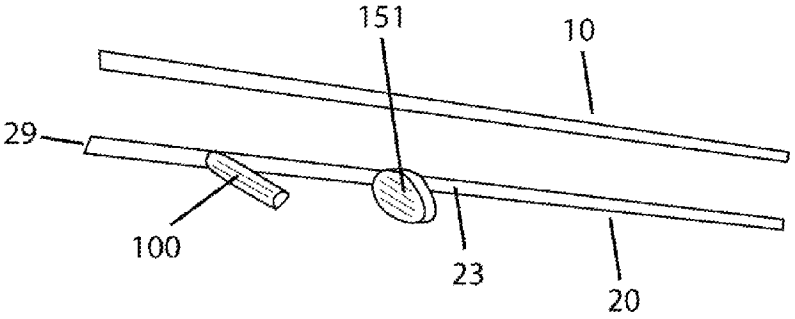
Figure 8:
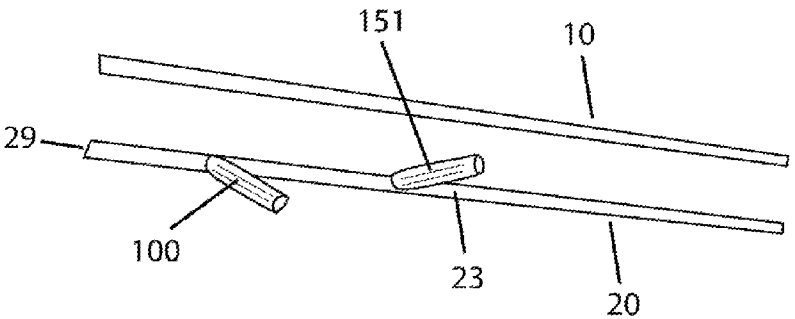
Figure 9:
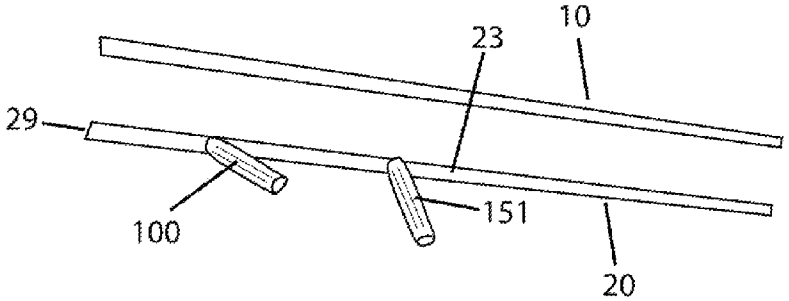

FIG. 8 to FIG. 10 shows some other variants of FIG. 7. Specifically, FIGS. 8 and 9 shows rod 151 may slant up or slant down; in other words, rod 151 can extend from the lower chopstick in different angles. FIG. 10 shows that protrusion 151 can be implemented in other shapes, such as a plate. These variants may also be applied on rod 100. Of course, the two protrusions may also be implemented in shapes other than a rod or a plate, as long as they can function as the first and the second protrusions.

In another embodiment of the present invention, a connecting element is arranged between the first and second protrusions for connecting the two protrusions, as shown in FIGS. 11 to 14.

Figure 11:
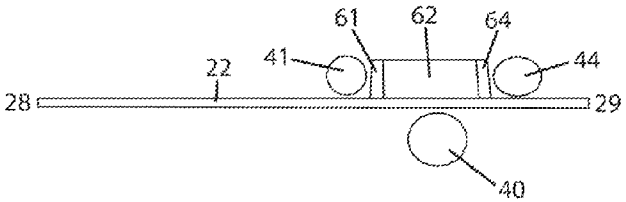
FIGS. 11-22 show other embodiments according to the present invention, wherein a connecting element for connecting the two protrusions is provided.

FIG. 11 shows a connecting element 62 merges with the first protrusion 61 and second protrusion 64, thus forming a rectangle plate as a whole. This plate-like structure can be better seen in FIG. 12, which is the back perspective view of FIG. 11.

Figure 14:
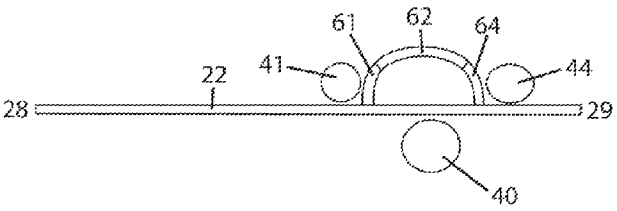
Figure 13:
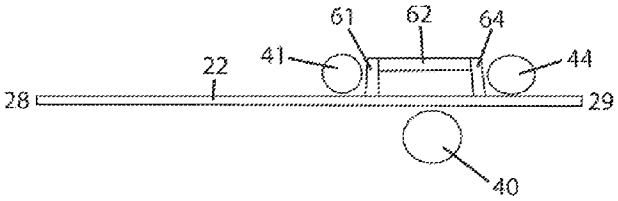

In addition to a plate-like structure, the connecting element 62 and the two protrusions may form a half-ring as a whole. "Half-ring" in the context means a structure that can form a hollow part between the half-ring and the lower chopstick, and it does not have to be half-circular. Such examples are shown in FIG. 13 and FIG. 14. In FIG. 13, the two protrusions 61, 64 and connecting element 62 together form a half-ring as a whole, where the half-ring is rectangular in shape. In FIG. 14, the two protrusions 61, 64 and connecting element 62 together form another half-ring as a whole, where the half-ring is half-circular in shape. These half-rings may also be described as "generally U-shaped structure". Other than rectangular or half-circular shapes, the half-rings can also be designed as other shapes, such as polygon.

Figure 15:
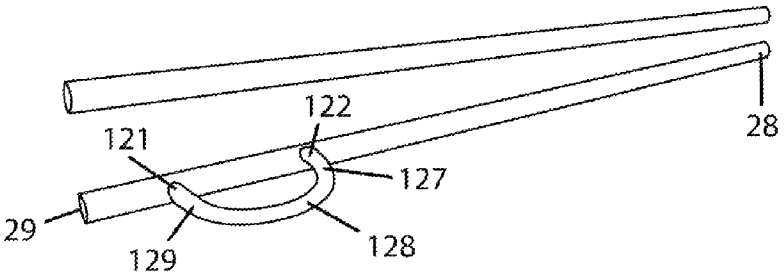
Figure 12:
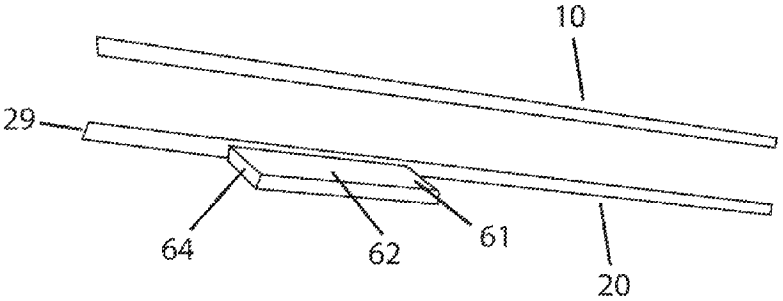
Figure 16:
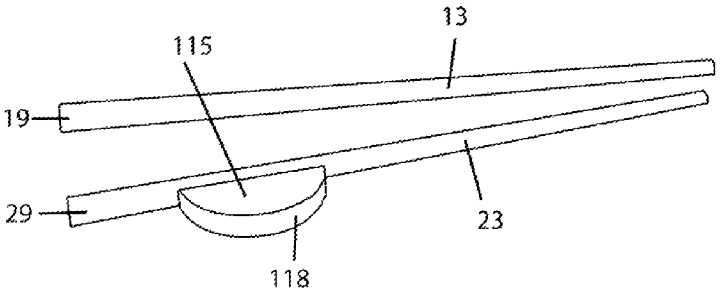

FIG. 15 shows the back perspective view of the half-ring embodiment of FIG. 14. The two ends 121 and 122 of the half-ring are mounted on the back surface of the lower chopstick, and the circumference thereof protrudes from the back surface of the lower chopstick. The distal end 127 of the half-ring functions as the first protrusion, and the rear end 129 thereof functions as the second protrusion. FIG. 16 is a variation of FIG. 15, where the space between the half-ring and the lower chopstick is filled so that a plate 115 is formed as a whole.

Figure 18:
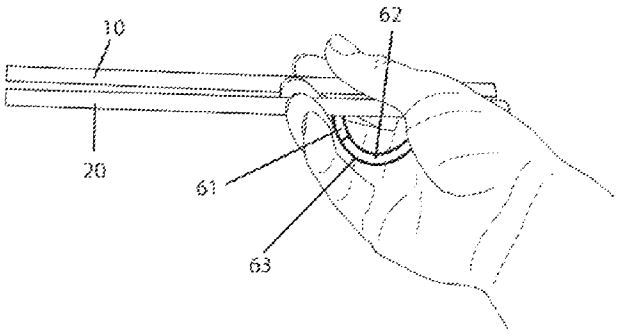
Figure 17:
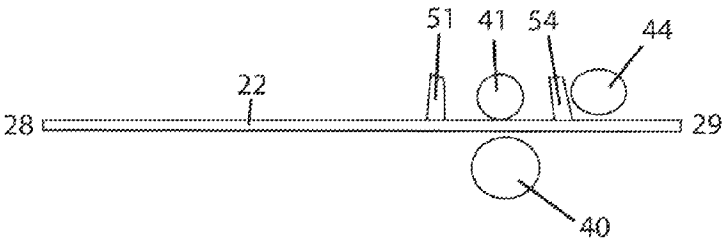

The connecting element may have the following advantages. First, the connecting element prevents the problem shown in FIG. 17, where the first joint of ring finger 41 will be easily moved to a wrong position. In this wrong position, the first joint of ring finger 41 is too close to the third section of index finger 44 and too close to the back surface of the lower chopstick, causing the lower chopstick cannot be held firmly. Therefore, connecting element 62 in FIGS. 11, 13, and 14 can prevent the first joint of ring finger 41 from getting too close to this wrong location. Second, the connecting element 62 may optionally touch the vicinity of the second joint of the ring finger. As shown in FIG. 18, an area 63 of connecting element 62 can touch the vicinity of the second joint of the ring finger, i.e., position 2 of the hand in FIG. 3. By means of contacting with position 2 that has not been considered in the current chopstick structures, connecting element 62 can provide additional supporting function, thus facilitating to form a correct holding posture. In addition, with the connecting element, rigidity and stability of protrusions are enhanced, and an aesthetic appearance is obtained.

Figure 19:
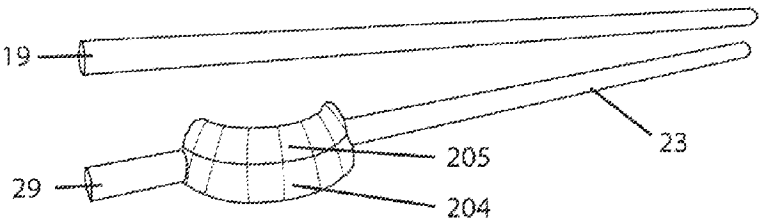
Figure 22:
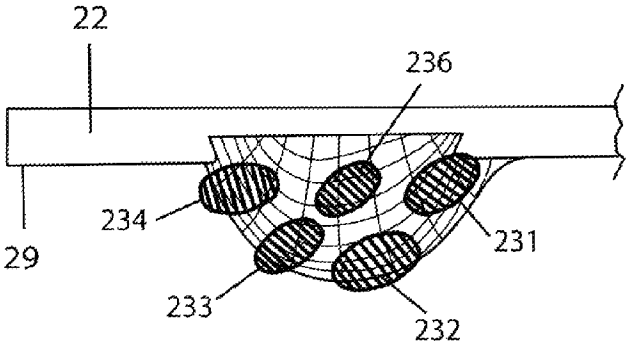
Figure 20:
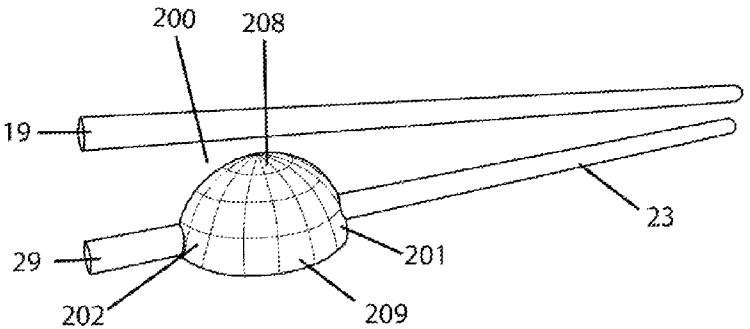
Figure 21:
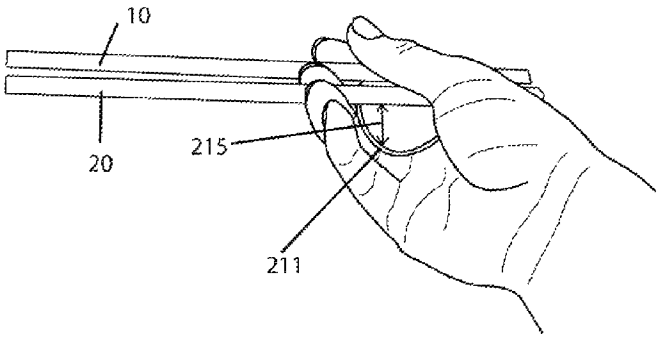

The surface area of the half-ring can be increased by adding extended portion on the half-ring. This half-ring and this extended portion may merge into one piece. Such an example is shown in FIG. 19, where a half-circular extended portion 205 is added on the top of half-ring 204. However, the half-ring and the extended portion are not limited to be half-circular. For example, they can both have a rectangular shape as shown in FIG. 13. In one particular case, the extension portion forms a quarter-spheroid 200 on the top of the half-ring, as shown in FIG. 20. The quarter-spheroid 200 can be also deemed as several half-rings being combined into one piece. The quarter-spheroid may be implemented as quarter-sphere, quarter-ellipsoid, polyhedrons (e.g. FIG. 31), or other similar shapes. As shown, an upper edge 208 of quarter-spheroid 200 protrudes from the upper surface of the lower chopstick. The distal end 201 and the rear end 202 of quarter-spheroid 200 function as the first and second protrusions 51 and 54 respectively. FIG. 21 shows that area 211 of quarter-spheroid 200 may touch the vicinity of the second joint of the ring finger, i.e., position 2 of the hand in FIG. 3, keeping that joint at a distance 215 from the back surface of the lower chopstick. FIG. 22 shows the top view of the quarter-spheroid embodiment, wherein areas 231, 232, 233, and 234 of quarter-spheroid 200 can respectively touch the vicinity of the first joint of the ring finger (position 1 in FIG. 3), the vicinity of the second joint of the ring finger (position 2 in FIG. 3), the finger pad of the third section of the middle finger (position 3 in FIG. 3), and the finger pad of the third section of the index finger (position 4 in FIG. 3). Also, area 236 blocks the second section of the middle finger from getting too close to the lower chopstick, i.e., blocks said position 6 in FIG. 3 from getting too close to the lower chopstick. In this way, the chopsticks can be significantly firmly held by the user in a correct posture.

Figure 23:
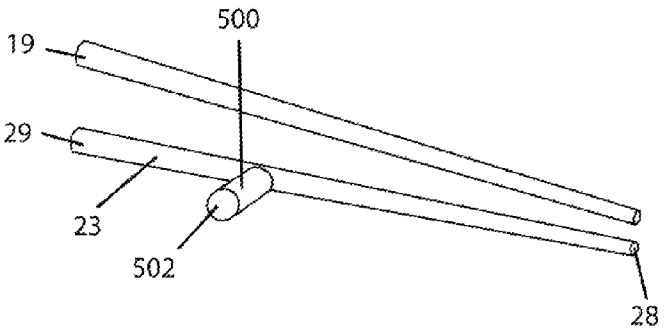
FIGS. 23-25 show some embodiments according to another aspect of the present invention.
Figure 24:
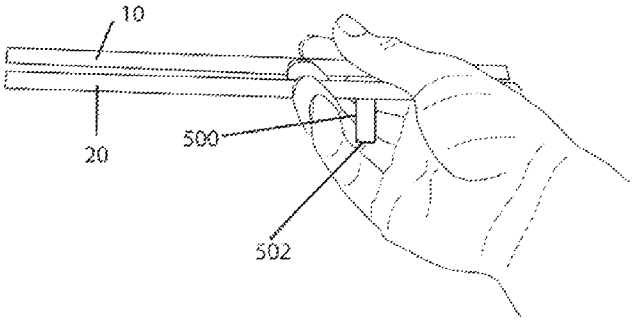

In another aspect of the present invention, a relative simple structure for improving the chopsticks holding property is proposed. Specifically, the lower chopstick is provided with a projection which can touch the vicinity of the second joint of the ring finger (position 2 in FIG. 3). One embodiment in this regard is shown in FIG. 23 and FIG. 24, in which a rod 500 protrudes from the back surface of the lower chopstick and the free end 502 of rod 500 touches the vicinity of the second joint of ring finger 2 (FIG. 24). In this way, the chopsticks can be also firmly held by user's hand.

This projection may exist on its own as shown in FIG. 23 and FIG. 24. Alternatively, the projection may, but not limited to, merge with the first and/or second protrusions as mentioned above. For example, connecting element 62 may function as the projection and merge with the first and the second protrusions. In FIG. 18 or FIG. 21, areas 63, 211 on connecting element 62 touch the vicinity of the second joint of the ring finger. More examples are shown in FIGS. 15, 16, 20, and 22, where areas 128, 118, 209, and 232 touch the vicinity of the second joint of the ring finger respectively. In these cases, areas 63, 211 or areas 128, 118, 209, and 232 can be deemed as the projection.

Figure 25:
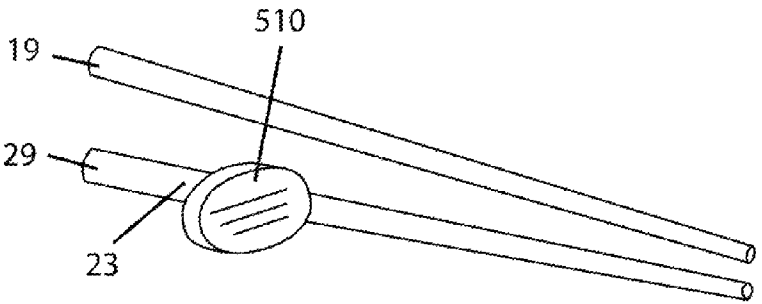

FIG. 25 shows another embodiment. The difference between the chopsticks shown in FIG. 25 and that shown in FIG. 23 only lies in a plate 510 instead of rod 500 protrudes from the back surface of the lower chopstick. One skilled in the art can easily understand plate 510 can function as rod 500 in the same way.

Figure 26:
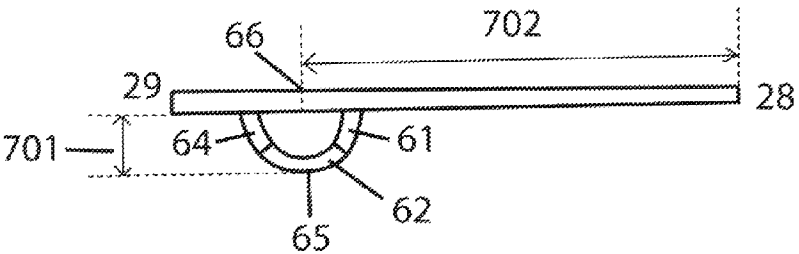
FIGS. 26-27 show the size relationship for the lower chopstick with protrusion/projection.
Figure 27:
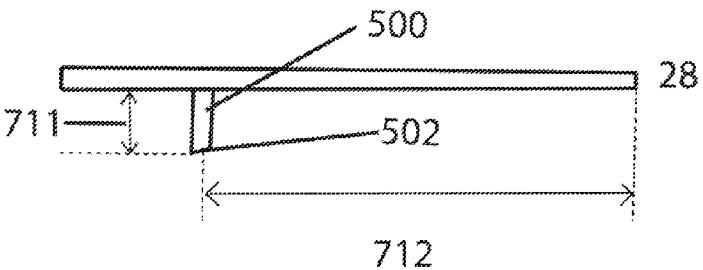

For embodiments which have projections for touching the vicinity of the second joint of the ring finger, it is optional that the embodiment have a particular size. FIG. 26 shows a top view of embodiment for the lower chopstick. In this Figure, distance L1, denoted by reference number 701, is the distance from the back surface of the lower chopstick to the top end 65 of connecting element 62, and distance L2, denoted by reference number 702, is the distance from the middle point 66 between protrusions 61 and 64 to the distal end 28 of the lower chopstick. The sizes may be chosen such that the result of multiplying the distance L1 by fifteen is larger than L2 (i.e. L1×15>L2). In another example, the result of multiplying L1 by ten is larger than L2 (i.e. L1×10>L2). Similarly, in FIG. 27, distance L1', denoted by reference number 711, is the distance from back surface of the lower chopstick to the free end of projection 502, and distance L2', denoted by reference number 712, is the distance from the middle of projection 502 to the distal end 28 of the lower chopstick. The sizes may be chosen such that the result of multiplying L1' by fifteen is larger than L2' (i.e. L1'×15>L2'). In another example, the result of multiplying L1' by ten is larger than L2' (i.e. L1'×10>L2'). With these sizes in the above mentioned ranges, the length of the protrusion or projection is long enough to touch the vicinity of second joint of the ring finger for most users, thus blocking that joint from getting too close to the lower chopstick.

L1 and L2 (or L1' and L2') can be respectively selected as the following sizes:

Adult size: 2.1 cm and 15.5 cm;

Junior size: 2 cm and 13.5 cm;

Children size: 1.8 cm and 12 cm; and

Baby size: 1.6 cm and 11 cm.

Figure 28:
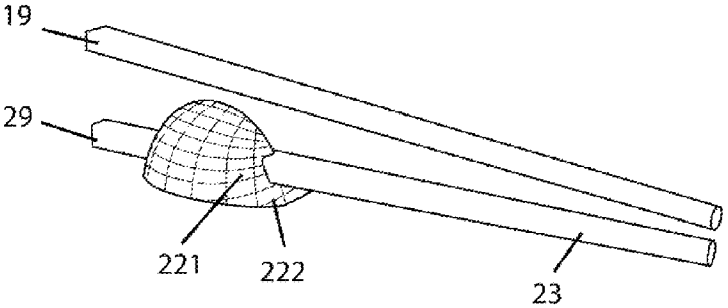
Figure 29:
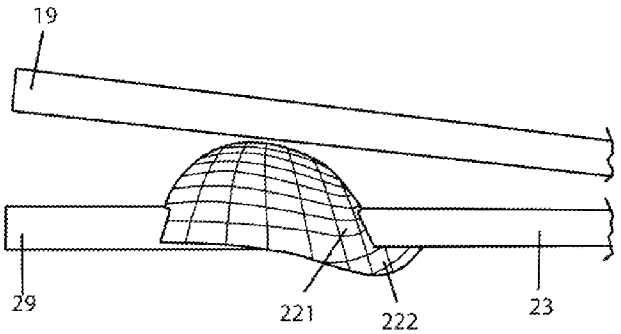

Any of the protrusions listed above may be further provided with an extension. Here are two examples:

In one example, as shown in FIGS. 28 and 29, an extension 222 extends from the distal end of the quarter-spheroid. The extension 222 extends downward from the distal end of the quarter-spheroid and increases the surface area contacting the vicinity of the first joint of the ring finger. Therefore, the lower chopstick can be held more stably. The extension 222 may also be combined in other embodiments, such as the half-ring embodiment.

Figure 30:
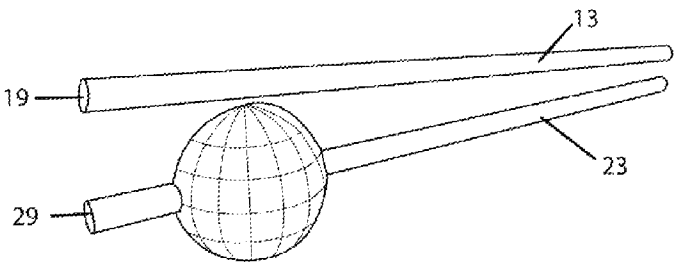
FIGS. 28-31 show some variants of the lower chopstick according to the present invention.

In another example, FIG. 30 shows an additional quarter-spheroid extending below the quarter-spheroid embodiment, thus forming a hemisphere as a whole. The surface of this hemisphere protrudes from the back of the lower chopstick. This hemisphere can further touch position 5 of hand (FIG. 3) in addition to the positions touched by quarter-spheroid 200 in the quarter-spheroid embodiment, thus further improving stability of chopsticks holding.

Also, the example may be modified so that as shown in FIG. 28 and FIG. 29 for example, position 221 of the quarter-spheroid is flattened in order to fit the shape of the ring finger.

Figure 31:
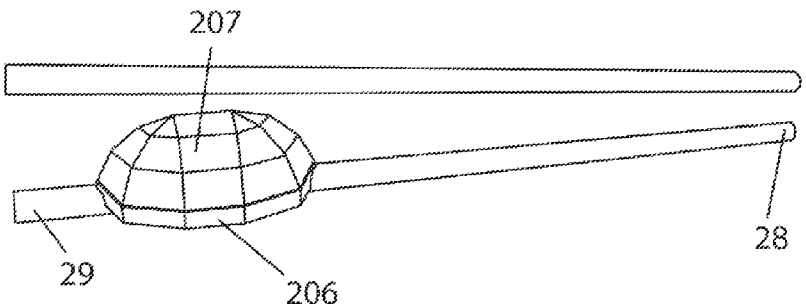

FIG. 31 shows another variation of quarter-spheroid embodiment. In this variation, a polyhedron 207 is extended from the top of a polygon half-ring 206 arranged on the lower chopstick. The polyhedron 207 is elongated, and functions as the quarter-spheroid in the embodiment as shown in FIG. 20. In this context, the term "polyhedron" should be understood as being fallen within the scope of the term "quarter-spheroid".

All the protrusions and projections mentioned above are mounted on the back surface of the lower chopstick. The mounting method can include, but not limited to: merging the protrusion with the lower chopstick and thus forming a single piece using injection molding, or, attaching the protrusion to the lower chopstick with adhesive. Alternatively, a chopstick inserting hole can be made in the protrusion for inserting the lower chopstick. In addition, a user adapter can be used also. Such adapter has a hole for inserting the lower chopstick 20, and the above protrusions can be mounted on the back of this adapter. Such adapter is disclosed for example in US2011/0169286A1.

Also, additional features can be arranged on the chopsticks also. For example, protrusions for the thumb and/or other fingers or a hinge for connecting the two chopsticks can be added. Examples in this regard can be found in WO 2011/015033 or WO2003/015589.

Although the invention is described in detail with reference to some embodiments, it will be apparent to those skilled in the art that modifications and variations may be made to some features/components/structures of the present disclosure without departing from the spirit or scope of the disclosure. In particular, the features disclosed in one embodiment can be combined with those disclosed in other embodiments in various ways unless the combinations may cause conflictions. It is intended that the present disclosure covers all the modifications and variations thereof.

The invention claimed is:

1. A pair of chopsticks, comprising:

an upper chopstick, and a lower chopstick with a first protrusion and a second protrusion, wherein both of the first and second protrusions protrude from the back surface of the lower chopstick, so that at the holding status of the chopsticks, the first protrusion can touch the vicinity of the first joint of the ring finger of user and the second protrusion can touch the finger pad of the third section of the index finger of user, a connecting element is provided for connecting the first protrusion and the second protrusion, the first and second protrusions and the connecting element together form a half-ring structure, an extension portion is extended on the top of the half-ring structure, wherein at the holding status of chopsticks the extension portion blocks the second section of the middle finger from getting too close to the lower chopstick.

2. The chopsticks according to claim 1, wherein the extension portion is a quarter-spheroid, the upper edge of the quarter-spheroid protruding from the upper surface of the lower chopstick and the lower edge of the quarter-spheroid merging with the half-ring structure.

3. The chopsticks according to claim 2, wherein said quarter-spheroid is a quarter-sphere or a quarter-ellipsoid.

4. The chopsticks according to claim 1, wherein the connecting element touches the vicinity of the second joint of the ring finger of user.

5. The chopsticks according to claim 1, wherein the distance L1 from the back surface of the lower chopstick to the top end of the connecting element and the distance L2 from the middle of the first protrusion and the second protrusion to the distal end of the lower chopstick satisfy the following relationship: $L1\times(10\sim15)>L2$.

6. The chopsticks according to claim 1, wherein the space between the half-ring structure and the lower chopstick is filled.

7. The chopsticks according to claim 1, wherein said half-ring structure and said extension portion merge together.

8. The chopsticks according to claim 1, wherein said extension portion is added on the top of said half-ring structure, and is a half-circular extension portion or a structure where several half-rings being combined into one piece.

9. The chopsticks according to claim 1, wherein an extension extends downward from said first protrusion, at the holding status of chopsticks, said extension touches the vicinity of the first joint of the ring finger of user.

10. The chopsticks according to claim 1, wherein said extension portion is not extended to a hemisphere, and/or is not extended to a spheroid.

11. The chopsticks according to claim 1, characterized in that, at the holding status of chopsticks, the vicinity of the first joint of the ring finger and the base of the third section of the index finger of the hand touch the back surface of the lower chopstick, the second section of the thumb of the hand touches the front surface of the lower chopstick, the first section of the thumb and the third section of the index finger of the hand touch the upper chopstick, and the first section of the index finger and the first section of the middle finger of the hand are to move the upper chopstick up and down.

12. The chopsticks according to claim 1, wherein the first protrusion is merged with or attached to the back surface of the lower chopstick, the second protrusion is merged with or attached to the back surface of the lower chopstick.

13. A pair of chopsticks comprising:

an upper chopstick, and a lower chopstick with a half-ring, the two ends of the half-ring being mounted on the back surface of the lower chopstick and the circumference of the half-ring protruding from the back surface of the lower chopstick, wherein a quarter-spheroid is extended on the top of the half-ring, the upper edge of the quarter-spheroid protruding from the upper surface of the lower chopstick and the lower edge of the quarter-spheroid merging with the half-ring.

14. The chopsticks according to claim 13, characterized in that at the holding status of chopsticks, the distal end of the quarter-spheroid touches the vicinity of the first joint of the ring finger of user.

15. The chopsticks according to claim 13, characterized in that at the holding status of chopsticks, the rear end of the quarter-spheroid touches the finger pad of the third section of the index finger of user.

16. The chopsticks according to claim 13, characterized in that the quarter-spheroid is a quarter-sphere or a quarter-ellipsoid.

17. The chopsticks according to claim 13, characterized in that the lower chopstick includes an extension extending downward from the distal end of the quarter-spheroid.

18. The chopsticks according to claim 17, characterized in that at the holding status of chopsticks, the extension touches the vicinity of the first joint of the ring finger of user.

19. The chopsticks according to claim 13, characterized in that, at the holding status of chopsticks, the quarter-spheroid touches the vicinity of the second joint of the ring finger the user.

20. The chopsticks according to claim 13, characterized in that, at the holding status of chopsticks, the vicinity of the first joint of the ring finger and the base of the third section of the index finger of the hand touch the back surface of the lower chopstick, the second section of the thumb of the hand touches the front surface of the lower chopstick, the first section of the thumb and the third section of the index finger of the hand touch the upper chopstick, and the first section of the index finger and the first section of the middle finger of the hand are to move the upper chopstick up and down.

21. The chopsticks according to claim 13, wherein the space between the half-ring and the lower chopstick is filled.

22. The chopsticks according to claim 13, wherein said quarter-spheroid is not extended to a hemisphere, and/or is not extended to a spheroid.

23. A pair of chopsticks comprising:

an upper chopstick and a lower chopstick, characterized in that a quarter-spheroid is provided on the lower chopstick, the quarter-spheroid having an upper edge protruding from the upper surface of the lower chopstick and a lower edge protruding from the back surface of the lower chopstick characterized in that the lower edge of the quarter-spheroid comprises a half-ring which has two end connected with the back surface of the lower chopstick and a circumference protruding from the back surface of the lower chopstick.

24. The chopsticks according to claim 23, characterized in that the distal end and the rear end of the quarter-spheroid protrude from the back surface of the lower chopstick, the distal end of the quarter-spheroid is merged with or attached to the back surface of the lower chopstick, and the rear end of the quarter-spheroid is merged with or attached to the back surface of the lower chopstick.

25. The chopsticks according to claim 23, characterized in that at the holding status of chopsticks, the distal end of the quarter-spheroid touches the vicinity of the first joint of the ring finger of user.

26. The chopsticks according to claim 23, characterized in that at the holding status of chopsticks, the rear end of the quarter-spheroid touches the finger pad of the third section of the index finger of user.

27. The chopsticks according to claim 23, characterized in that the quarter-spheroid is a quarter-sphere or a quarter-ellipsoid.

28. The chopsticks according to claim 23, characterized in that the lower chopstick includes an extension extending downward from the distal end of the quarter-spheroid.

29. The chopsticks according to claim 28, characterized in that at the holding status of chopsticks, the extension touches the vicinity of the first joint of the ring finger of user.

30. The chopsticks according to claim 23, characterized in that the two ends of the half-ring protrude from the back surface of the lower chopstick and are connected by a connecting element to form the half-ring.

31. The chopsticks according to claim 23, characterized in that the half-ring is merged or integrally formed with the lower edge of the quarter-spheroid.

32. The chopsticks according to claim 23, characterized in that, at the holding status of chopsticks, the quarter-spheroid touches the vicinity of the second joint of the ring finger of the user.

33. The chopsticks according to claim 23, characterized in that, at the holding status of chopsticks, the vicinity of the first joint of the ring finger and the base of the third section of the index finger of the hand touch the back surface of the lower chopstick, the second section of the thumb of the hand touches the front surface of the lower chopstick, the first section of the thumb and the third section of the index finger of the hand touch the upper chopstick, and the first section of the index finger and the first section of the middle finger of the hand are to move the upper chopstick up and down.

34. The chopsticks according to claim 23, wherein the said quarter-spheroid is not extended to a hemisphere, and/or is not extended to a spheroid.

* * * * *